United States Patent [19]

Shibata et al.

[11] Patent Number: 4,457,698

[45] Date of Patent: Jul. 3, 1984

[54] OIL BURNER

[75] Inventors: Kenji Shibata, Ashikaga; Noboru Takahashi, Sano, both of Japan

[73] Assignees: Sanyo Electric Co., Ltd.; Tokyo Sanyo Electric Co., Ltd., both of Japan

[21] Appl. No.: 376,955

[22] Filed: May 11, 1982

[30] Foreign Application Priority Data

Jun. 26, 1981 [JP] Japan ..... 56-99911

[51] Int. Cl.[3] ..... F23D 3/32; F23Q 7/08

[52] U.S. Cl. ..... 431/254; 431/88; 431/262; 431/308

[58] Field of Search ..... 126/96; 431/196, 88, 431/262, 256, 254, 304, 308, 315

[56] References Cited

U.S. PATENT DOCUMENTS 550,704 12/1895 Whittingham ..... 431/308

3,251,395 5/1966 Suma ..... 431/254

FOREIGN PATENT DOCUMENTS 47-31698 9/1972 Japan .

47-32662 10/1972 Japan .

54-142630 1/1979 Japan ..... 431/88

56-46928 4/1981 Japan ..... 431/262

932421 7/1963 United Kingdom ..... 431/262

1392773 4/1975 United Kingdom ..... 431/315

*Primary Examiner*—Lee E. Barrett

*Attorney, Agent, or Firm*—Darby & Darby

[57] ABSTRACT

Oil burner, having an ignition mechanism and a wick movable upwardly and downwardly, and being operated with ease by completing wick lifting and ignition simultaneously in a single operation.

8 Claims, 14 Drawing Figures

OIL BURNER

BACKGROUND OF THE INVENTION

The present invention relates to an oil burner having a system which can lift and ignit the wick simultaneously in a single operation.

Conventional oil burners such as small-size oilstoves include a rack-and-pinion mechanism for moving a wick upwardly and downwardly (as is disclosed in Published examined utility model application No. 31698/1972 and No. 32662/1972). The rack is secured to the wick and the pinion is attached to a shaft for lifting and lowering the wick, the pinion being held in mesh with the rack. The wick can be moved upwardly and downwardly in response to the rotation of the shaft. With the rack-and-pinion mechanism, however, the wick cannot be raised to a position in which oil can be burned until the shaft makes one to two revolutions, a procedure which renders the wick lifting operation tedious and time-consuming. It is necessary to actuate an ignition lever after the wick lifting operation has been completed. Therefore, the wick lifting and igniting operations have to be carried out separately, and hence required time and labor.

SUMMARY OF THE INVENTION

It is an object of the present invention to provide an oil burner which will eliminate the prior difficulties.

Another object of the present invention to provide an oil burner which can be operated with ease by completing wick lifting and ignition simultaneously in a single operation.

According to the present invention, an oil burner comprises an oil tank, an air introduction cylinder, a wick extending around the air introduction cylinder and movable upwardly and downwardly, and a cylindrical wick support affixed to an outer periphery of the wick. A crank bearing plate is attached to the wick support and a crank is held in engagement with the crank bearing plate for moving the wick upwardly and downwardly. The oil burner further comprises a shaft support base secured to the oil tank at an exterior thereof, a wick control shaft having one end rotatably supported on the shaft support base and the other end projecting into the oil tank and mounting thereon the crank, a wick lifting lever pivotably supported on the shaft support base for angular movement about a pivot and having a controlling end movable downwarldy for rotating the wick control shaft in a direction to lift the wick, an ignition lever actuatable in ganged relation to the wick lifting lever, mechanism actuatable in response to the operation of the ignition lever and having an ignition heater for igniting the wick, and a return spring for returning the wick lifting lever.

The wick can be moved upwardly and downwardly by the crank bearing plate mounted on the wick and the crank mounted on the wick control shaft and held in engagement with the crank bearing plate. Since the wick can be moved from an extinguishing position to a burning position by rotating the wick control shaft a small angular interval. And the wick lifting lever needs to be angularly moved only through a small angle, it can be actuated quickly to bring the wick up to the burning position. The ignition lever for actuating the ignition mechanism is pivotably mounted on the shaft support base so as to be angularly movable in a direction substantially perpendicularly to the wick lifting lever.

Since the ignition mechanism can be located relatively in the vicinity of the shaft support base, the component parts are positioned in a relatively small area, and the wick lifting lever and the ignition mechanism are interlinked through a simple construction.

The above and other objects, featres and advantages of the present invention will become more apparent from the following description when taken in conjunction with the accompanying drawings in which certain preferred embodiments of the invention are shown by way of illustrative example.

DESCRIPTION OF THE PREFERRED EMBODIMENTS

Figure 1:
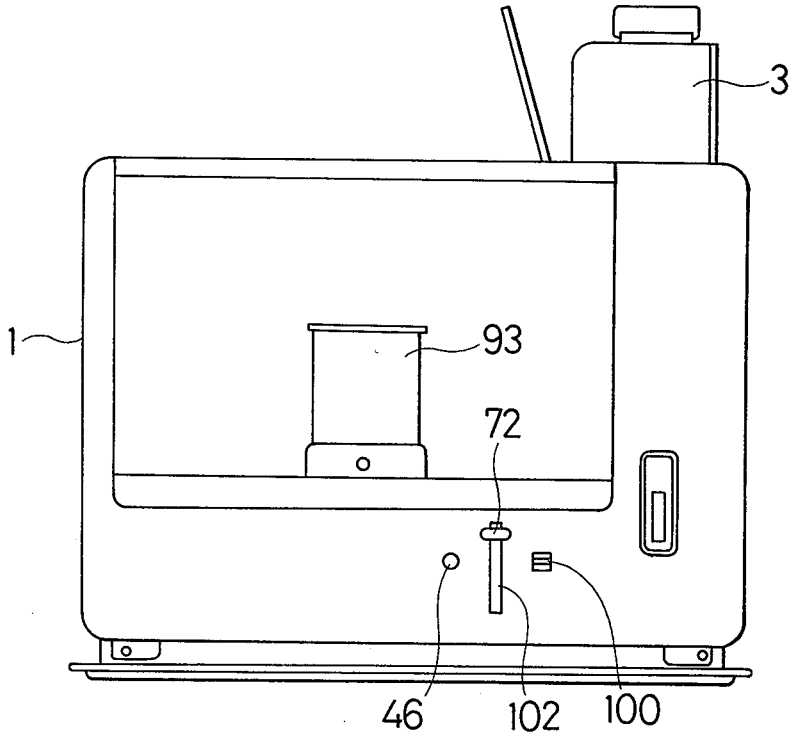
FIG. 1 is a front elevational view of an oil burner according to an embodiment of the present invention.
Figure 2:
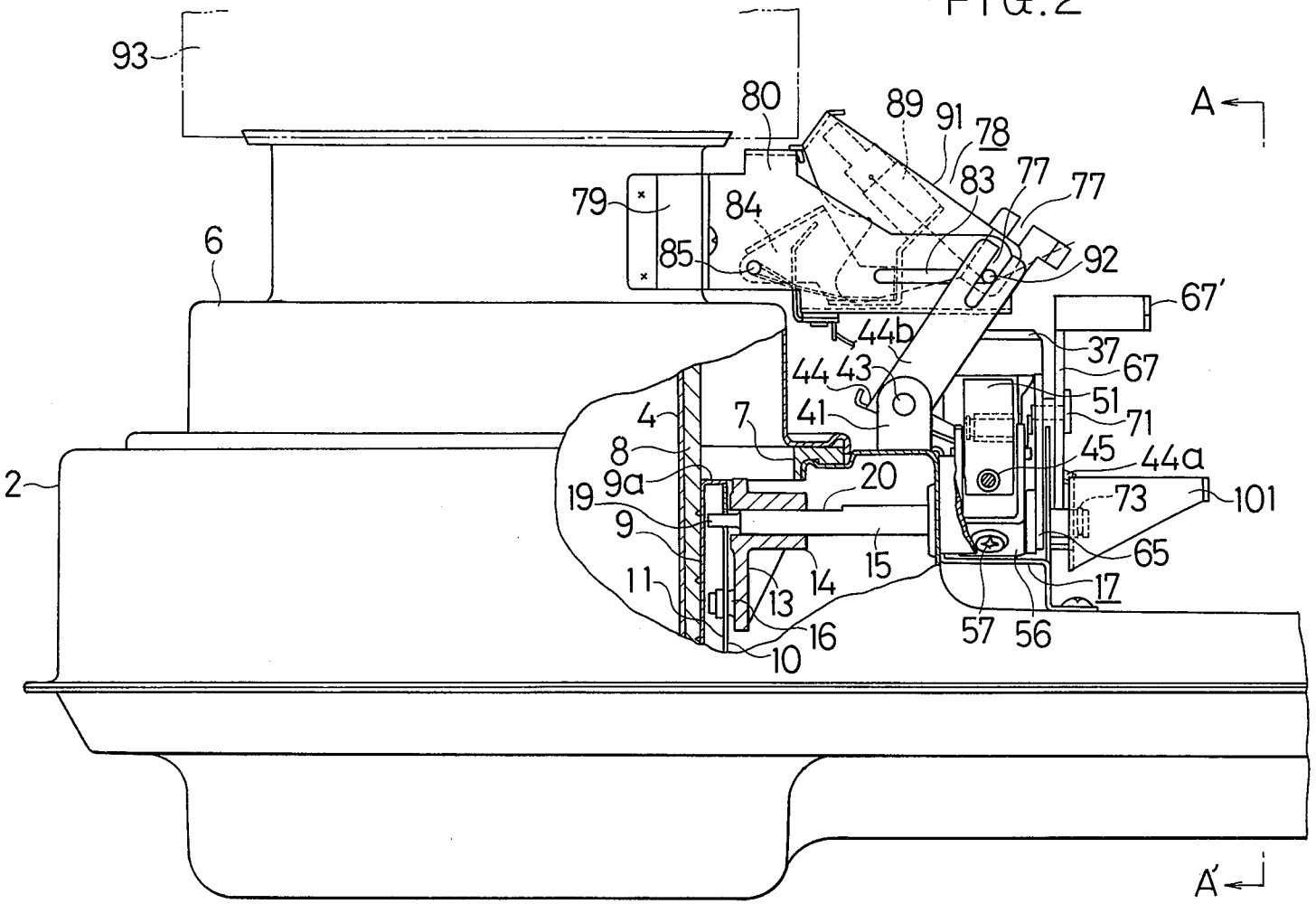
FIG. 2 is an enlarged fragmentary front elevational view, partly cut away, of the oil burner.
Figure 12:
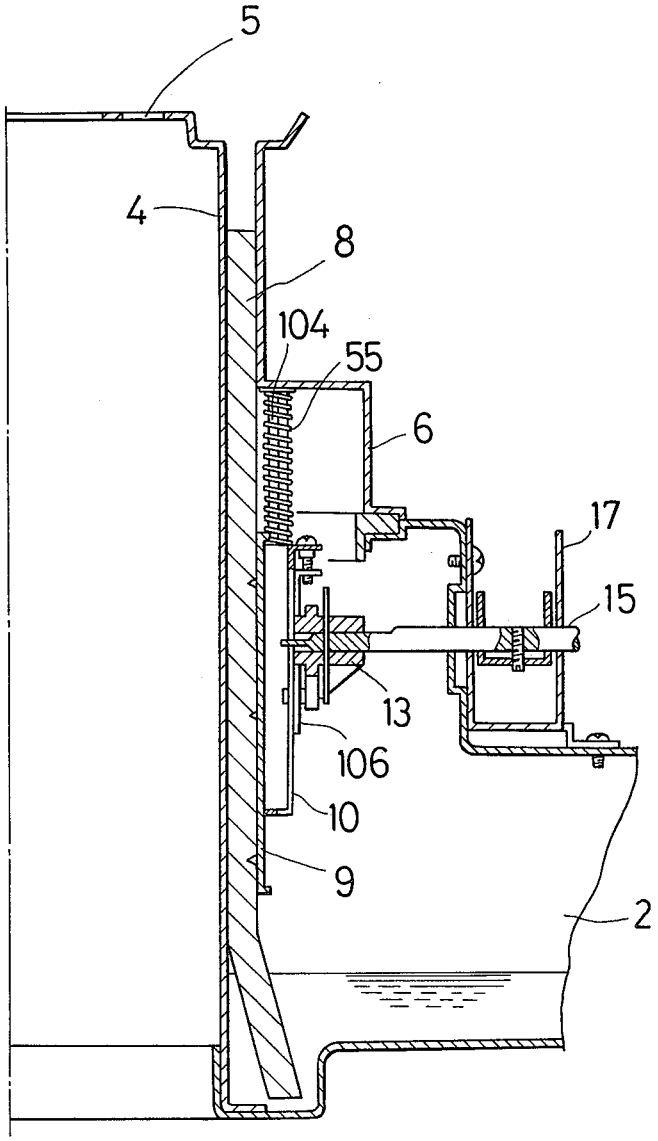
FIG. 12 is an enlarged fragmentary cross-sectional view of the portion shown in FIG. 11.

An oil burner, which is in the form of an oilstove in the illustrated embodiment, comprises an outer casing 1 and an oil tank 2 fixedly housed in a lower portion of the outer casing 1, as shown in FIGS. 1 and 2. The oil tank 2 is supplied with oil from a cartridge tank 3 which is removably accommodated in the outer casing 1 at one side thereof and connected to one end of the oil tank 2. A hollow air introduction cylinder 4 is mounted on the oil tank 2 at its other end and projects upwardly therefrom, the air introduction cylinder 4 having an upper air hole 5, as illustrated in FIG. 12. A wick frame 6 is detachably mounted on the oil tank 2 with a gasket 7 interposed therebetween. A cylindrical wick 8 extends peripherally around the air introduction cylinder 4 and is movable upwardly and downwardly in a space defined between the wick frame 6 and the air introduction cylinder 4. The cylindrical wick 8 has a lower portion dipped in oil in the oil tank 2. A cylindrical wick support 9 of metal is attached to and extends around a central peripheral portion of the wick 8, which is fixed to the wick support 9 by raised prongs thereon. The wick support 9 has on its upper end an annular flange 9a bent and projecting outwardly, the flange 9a having a width of about 5 mm.

A crank bearing plate 10 is secured by spot welding at lateral ends to the wick support 9 on its outer periphery, the crank bearing plate 10 being formed by pressing a single sheet of metal to desired contour. The crank bearing plate 10 includes a vertical flat portion 10' having a vertical oblong hole 11 located at a lefthand end portion thereof and opening downwardly. The vertical flat portion 10' also has a horizontal oblong hole 12 which is positioned to the right and vertically substantially centrally of the flat portion 10'.

A horizontal elongate crank 13 is formed of oil-resistant synthetic resin and has on one end thereof a shaft support 14 in which a wick control shaft 15 is removably mounted for corotation. The crank 13 has a pin 16 projecting integrally from a rear surface thereof at a distal end thereof, the pin 16 engaging in the horizontal oblong hole 12 in the crank bearing plate 10. When the crank 13 is angularly moved counterclockwise, the pin 16 is caused to slide to the left in the horizontal oblong hole 12, lifting the wick 8 rectilinearly.

The wick control shaft 15 is in the form of a small-diameter cylindrical rod having a proximal end rotatably supported on a shaft support base 17 affixed to an outer surface of the oil tank 2. The other end of the wick control shaft 15 projects through a sidewall of the oil tank 2 thereinto and fits in the shaft support 14. The projecting end of the wick control shaft 15 is secured to the shaft support 14 by a removable locking pin 18. The wick control shaft 15 has on its distal end a small-diameter concentric portion 19 which extends through the crank 13 and fits in the vertical oblong hole 11 in the crank bearing plate 10 for guiding vertical rectilinear movement of the crank bearing plate 10. The wick control shaft 15 also includes a crank attachment portion 20 of a substantially D-shaped cross section adjacent to the small-diamter portion 19, the crank attachment portion 20 serving to prevent the crank 13 from rotating idly on the wick control shaft 15. The crank attachment portion 20 has a radial hole 21 in which the locking pin 18 is inserted.

Figure 7:
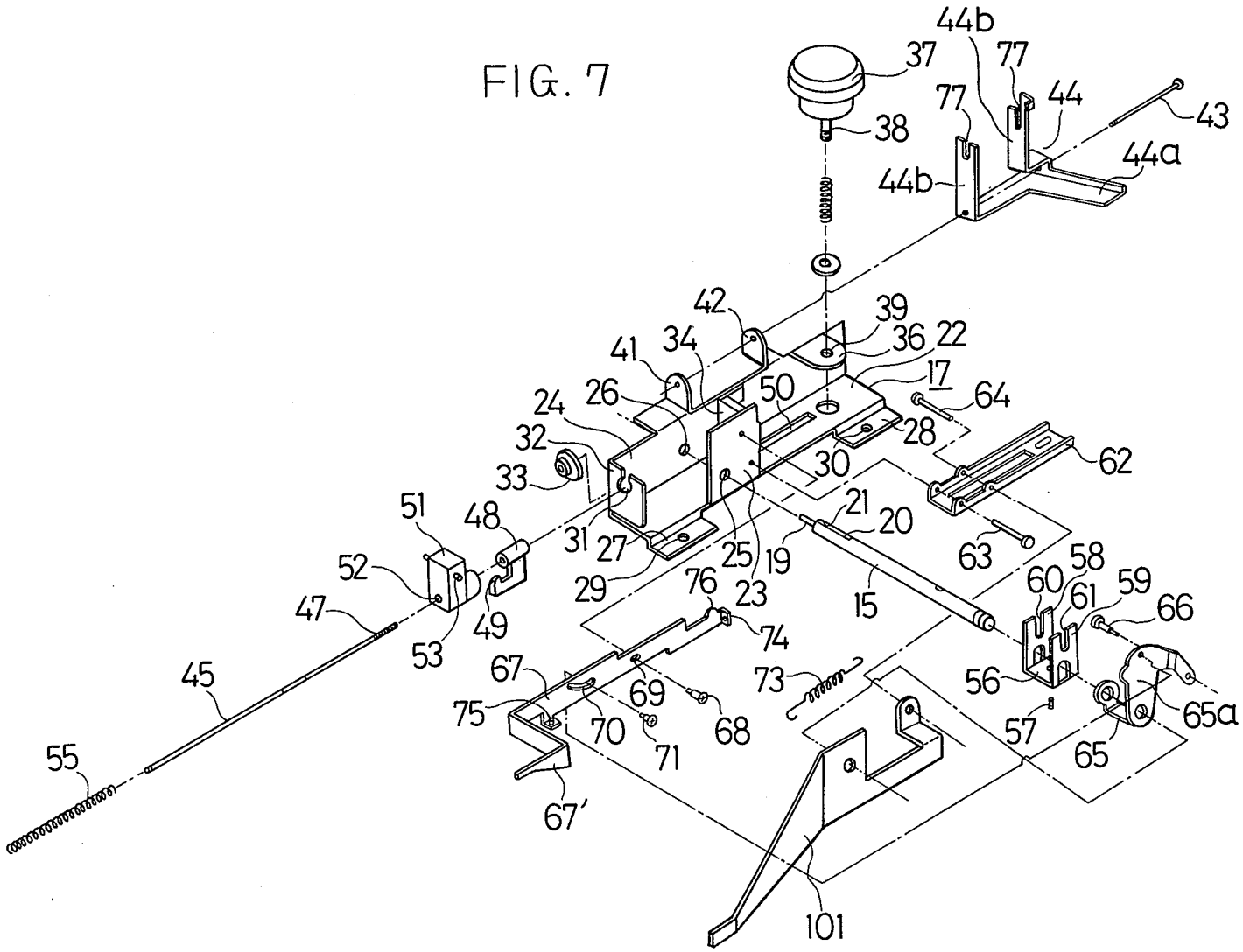
FIG. 7 is an exploded perspective view of the mechanism illustrated in FIG. 5.

As shown in FIG. 7, the shaft support base 17 includes a lower plate 22, and upwardly bent outer and inner plates 23, 24 extending from lateral sides of the lower plate 22 and having through holes 25, 26, respectively, through which the wick control shaft 15 extends. The shaft support base 17 also includes a pair of L-shaped attachment legs 27, 28 having screw holes 29, 30, respectively, and a front plate 32 bent laterally from a front end of the inner plate 24. The front plate 32 has an aperture 31 in its central upper portion, there being a shaft bearing circular plate or disc 33 of synthetic resin fitted in the aperture 31. The outer plate 23 has a support plate 34 bent inwardly from an end thereof and having a through hole 35 which is held in alignment with the aperture 31 in the front plate 32. The inner plate 24 has a mount member 36 for mounting thereon a vibration sensor 37. The mount member 36 has a small-diameter central hole 39 through which extends a vertical actuation rod 38 of the vibration sensor 37. A pair of spaced support members 41, 42 are bent upwardly from an upper edge from the inner plate 24. An ignition lever 44 is angularly movably supported on the support members 41, 42 by a pin 43 extending therebetween.

A latch shaft 45 is axially movably supported by the front plate 32 and the support plate 34 of the shaft support base 17. The latch shaft 45 has on a front end thereof a knob 46 (FIG. 3) and extends axially in a direction normal to the wick control shaft 15. The latch shaft 45 also includes on its rear end an externally threaded portion 47 on which there is threadedly mounted a latch 48 of synthetic resin that has a locking pawl 49 on one end thereof. The latch 48 has a lower end portion slidably received in a guide slot 50 defined through the lower plate 22 of the shaft support base 17 for preventing the latch shaft 45 from being rotated about its own axis. A latch shaft actuating body 51 of synthetic resin has a hole 52 and a guide pin 53 extending in a direction perpendicularly to the hole 52. The latch shaft 45 extends loosely through the hole 52, with the latch shaft actuating body 51 affixed to the latch shaft 45 by and between a pair of motion-limiting rings 54 mounted at suitable positions on the latch shaft 45. A spring 55 is disposed around the latch shaft 45 between the shaft bearing disc 33 and the latch shaft actuating body 51. The spring 55 is compressible to store energy when the latch shaft 45 is axially moved in a forward direction.

A substantially channel-shaped swingable arm 56 is disposed in the shaft support base 17 and secured at a base to the wick control shaft 15 by a threaded rod 57. The swingable arm 56 includes a pair of arm members 58, 59 having recesses 60, 61, respectively, in which the ends of the guide pin 53 on the latch shaft actuating body 51 are fitted, respectively. An actuation plate 62 is angularly movably supported on the shaft support base 17 by a rod 63 and has a locking pin 64 mounted on the actuation plate 62. When the latch shaft 45 is axially moved forward, the locking pawl 49 of the latch 48 is held in locking engagement with the locking pin 64. The actuation plate 62 has one end, which is remote from the rod 63, operatively connected to the vertical actuation rod 38 of the vibration sensor 37. Upward movement of the vertical actuation rod 38 upon vibration of the vibration sensor 37 causes the end of the actuation plate 62 to move upwardly until the latch 48 is released of engagement with the locking pin 64.

An interlink lever 65 has its base angularly mounted on the wick control shaft 15 in the shaft support base 17 and includes an angularly bent portion 65a having on its distal end a roller 66 which is engageable with the latch shaft actuating body 51 to displace the same.

A wick lifting lever 67 is angularly movably supported by a pivot pin 68 on the outer plate 23 of the shaft support base 17. The wick lifting lever 67 has a horizontal slot 69 through which the pivot pin 68 extends and an angularly curved slot 70 located forward of the horizontal slot 69. An interlinking rod 71 extends through the angularly curved slot 70 threadedly into the angularly bent portion 65a of the interlink lever 65. When a pushbutton 72 (FIG. 3) mounted on a controlling end 67' of the wick lifting lever 67 is depressed, the interlinking rod 71 is caused to slide in the angularly curved slot 70, turning the interlink lever 65 counterclockwise to enable the roller 66 on the interlink lever 65 to displace the latch shaft actuating body 51 in the forward direction. A return spring 73 has one end connected to an end of the wick control shaft 15 and the other end connected to a distal engaging end 74 of the wick lifting lever 67. The wick lifting lever 67 is urged by the return spring 73 in a direction to return to the original position. The wick lifting lever 67 has a member 75 for adjusting a lower position for the wick lifting lever 67.

The ignition lever 44 is substantially L-shaped in side elevation, and includes a lifting and lowering plate 44*a* on one side and a pair of arms 44*b*, 44*b* on the other side which extend substantially perpendicularly to the lifting and lower plate 44*a*. The ignition lever 44 is angularly movable in a direction which is substantially normal to the direction in which the wick lifting lever 67 is angularly movable. Upon such angular movement, the lifting and lowering plate 44*a* has its distal end raised by an arcuate projection 76 on the distal end of the wick lifting lever 67. The arms 44*b*, 44*b* have in their distal ends recesses 77, 77, respectively, which serve as engagement grooves.

Figure 3:
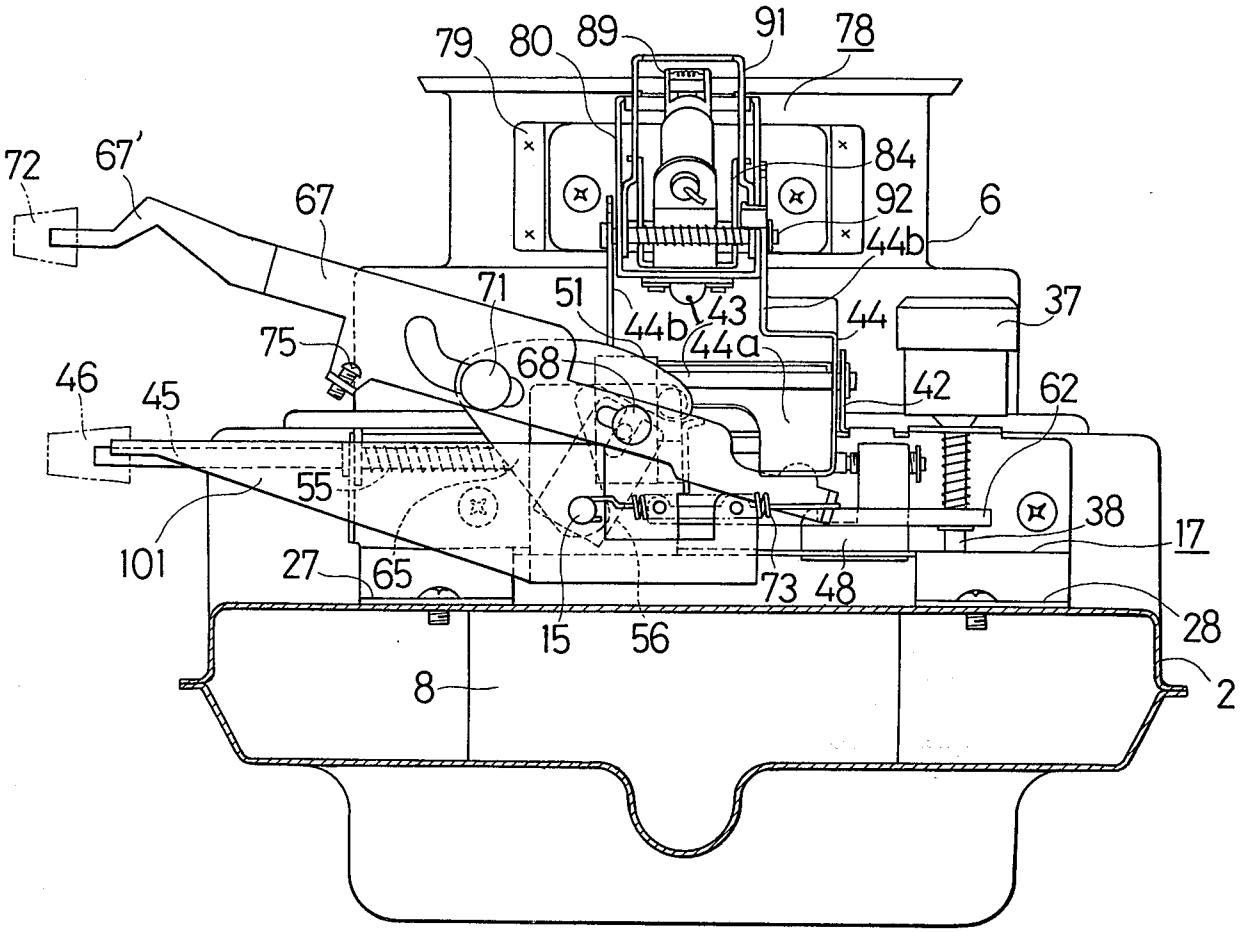
FIG. 3 is a cross-sectional view taken along line A—A' of FIG. 2.
Figure 8:
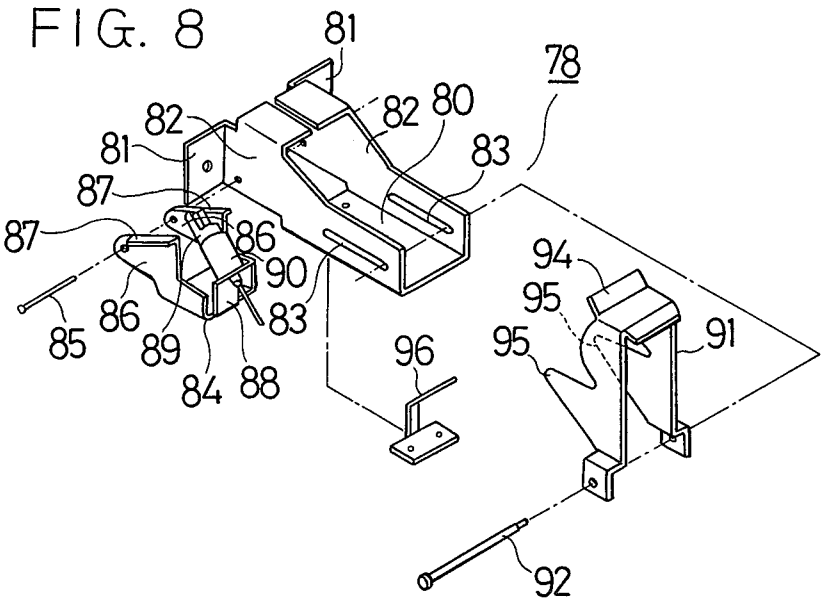
FIG. 8 is an exploded perspective view of an ignition mechanism.
Figure 10:
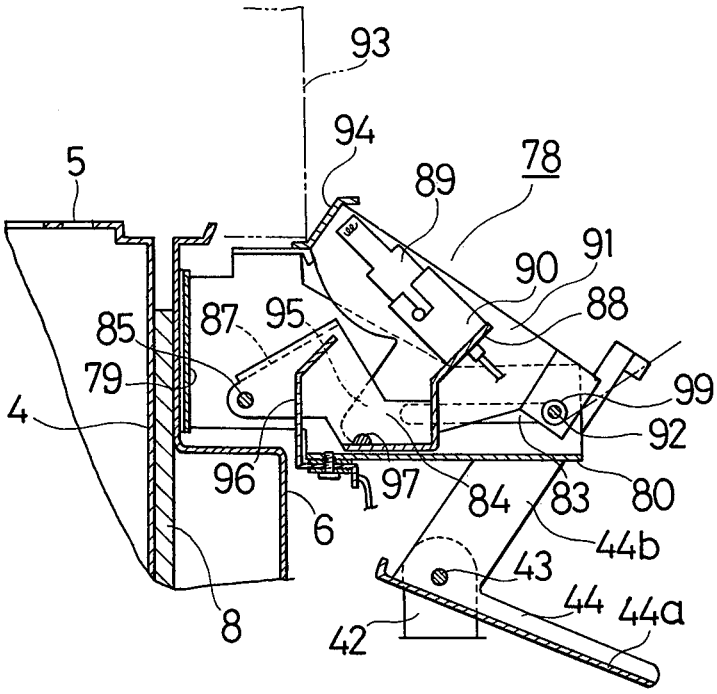
FIG. 10(A) is a cross-sectional view showing the ignition mechanism before being actuated.
FIG. 10(B) is a cross-sectional view showing the ignition mechanism after being actuated.
Figure 10:
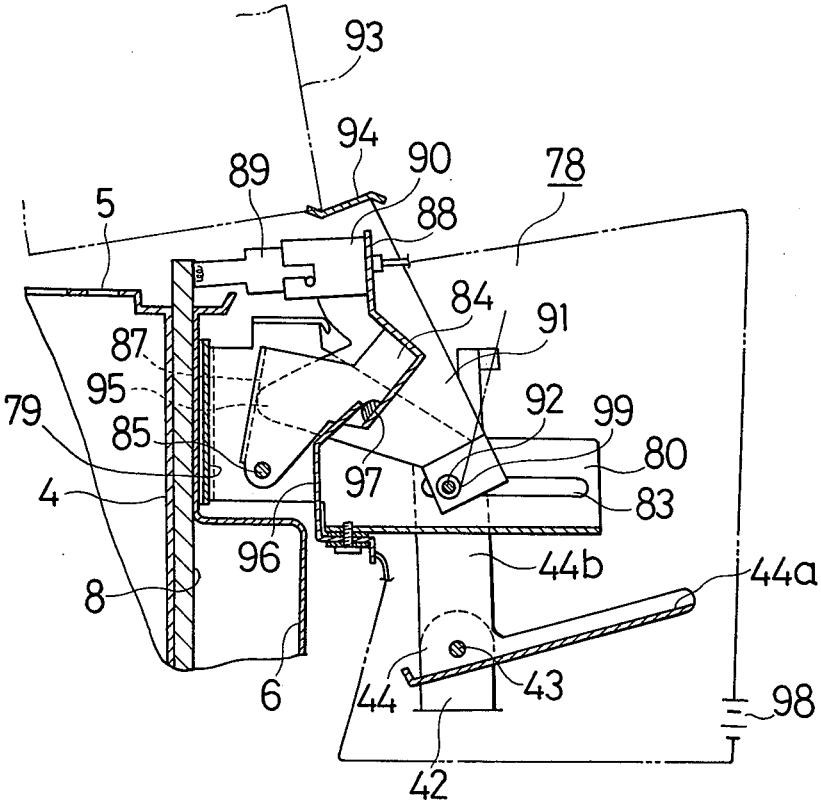

An ignition mechanism 78 will be described with reference to FIGS. 2, 3 and 8. An ignition mechanism attachment 79 is secured by spot welding to an outer periphery of the wick frame 6. A channel-shaped fixture 80 has a pair of lateral attachment flanges 81, 81 affixed to the outer periphery of the wick frame 6 by screws threaded into the attachment 79. The fixture 80 includes a pair of sidewalls 82, 82 contiguous respectively to the flanges 81, 81 and having horizontal oblong slots 83, 83, respectively, at their lower rear portions. An ignition arm 84 is angularly movably mounted at one end by a pivot pin 85 on a lower front portion of the fixture 80. The ignition arm 84 includes a pair of confronting walls 86, 86 having bent flanges 87, 87, respectively, which are slanted upwardly away from the ends that are pivotably supported by the pivot pin 85. An angularly bent upstanding member 88 projects from the other end of the ignition arm 84, and has on its upper front surface a heater socket 90 to which an ignition heater 89 is attached. A lifter lever 91 for lifting a combustion cylinder 93 is pivotably supported at its lower end by an actuation shaft 92 which extends through the horizontal slots 83, 83 in the fixture 80. For lifting the combustion cylinder 93, the lifter lever 91 has its front end 94 brought into abutment against a lower periphery of the combustion cylinder 93. When the actuation shaft 92 slides in the slots 83 toward the wick frame 6, the lifter lever 91 is moved upwardly to lift the combustion cylinder 93. At the same time, projections 95, 95 of the lifter lever 91 are brought into abutting engagement with the slanted flanges 87, 87, respectively, of the ignition arm 84, which is then caused to move angularly. The angular movement of the ignition arm 84 enables the ignition heater 89 to approach the wick 8 as it is raised. The actuation shaft 92 has its opposite ends projecting laterally out of the slots 83, 83 in the fixture 80 into the engagement grooves 77, 77, respectively, in the arms 44*b*, 44*b* of the ignition lever 44. Thus, the actuation shaft 92 is angularly movable in response to angular movement of the ignition lever 44. A contact 96 is fixed to the fixture 81, and another contact 97 is mounted on the ignition arm 84 and electrically connected to the ignition heater 89. A battery 98 (FIG. 10(*b*)) serves to supply electric power to the ignition heater 89. A spring 99 is disposed around the actuation shaft 92, and has one end held against the lifter lever 91 and the other end held against an upper end of the arm 44*b* of the ignition lever 44.

Designated in FIG. 1 at 100 is an extinguishing pushbutton mounted on a distal end of an extinguishing lever 101 (FIG. 2). When the extinguishing puhsbutton 100 is depressed, the other end of the actuation plate 62 is moved upwardly to disengage the latch 48 from the locking pin 64.

The oil burner thus constructed will operate as follows: When the pushbutton 72 shown in FIG. 1 is moved downwardly along a slide slot 102 defined in the outer casing 1 of the oil burner, the wick lifting lever 67 is angularly moved about the pivot pin 68 from the solid-line position A (FIG. 9) to the imaginary-line position B. As the interlinking rod 71 moves leftward in the angularly curved slot 70, the interlink lever 65 is angularly moved counterclockwise about the wick control shaft 15.

Figure 6:
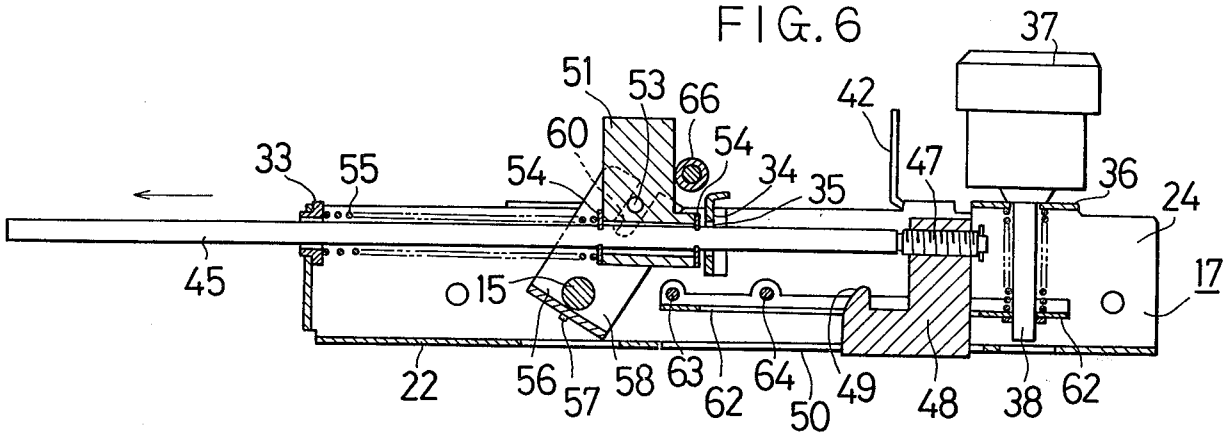
FIG. 6 is a longitudinal cross-sectional view of the mechanism shown in FIG. 5, with an ignition lever removed.

The angular movement of the interlink lever 65 causes the roller 66 to move the latch shaft actuating body 51 forward (leftward as shown in FIG. 6). At this time, the latch shaft 45 moves with the latch shaft actuating body 51 in the forward direction, and the guide pin 53 turns the swingable arm 56 counterclockwise. When the swingable arm 56 is thus turned, the wick control shaft 15 is rotated in a direction to lift the wick 8. The latch shaft 45 as it moves forward compresses the spring 55. When the latch shaft 45 completes the forward movement by a predetermined amount, the locking pawl 49 of the latch 48 on the latch shaft 45 engages the locking pin 64 of the actuation plate 62. The spring 55 on the latch shaft 45 stores energy as it is compressed, and when the locking pawl 49 is brought into engagement with the locking pin 64, the spring 55 remains compressed with the stored energy unreleased. Up to this time, the wick 8 has been lifted to the burning position, and the ignition mechanism 78 has been actuated to bring the ignition heater 89 closely to the wick 8 through operation of the wick lifting lever 67 via the ignition lever 44.

Figure 4:
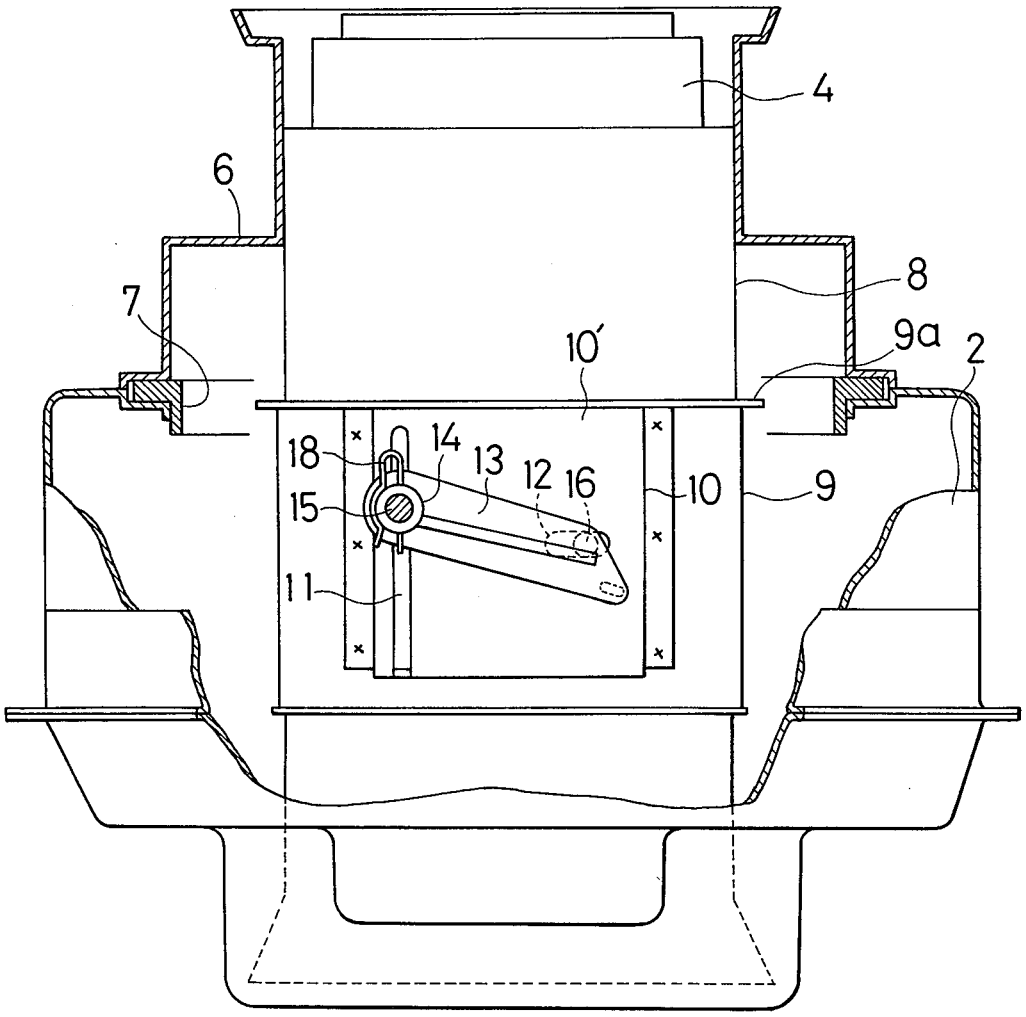
FIG. 4 is a side elevational view, with parts in cross section, of a portion of the oil burner.
Figure 5:
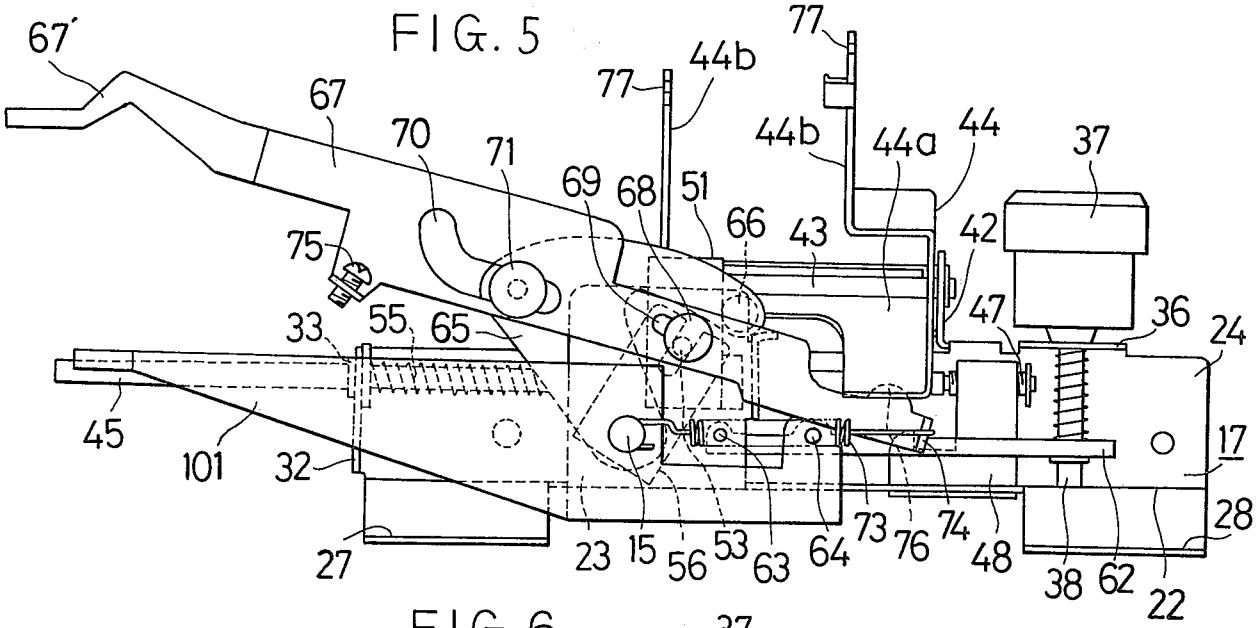
FIG. 5 is a front elevational view of a mechanism for moving a wick upwardly and downwardly.

The movement of the wick 8 will now be described with reference to FIG. 4. The wick 8 is shown in FIG. 4 as being in the extinguishing position (lowermost position). As the wick control shaft 15 is turned counterclockwise, the crank 13 is angularly moved about the wick control shaft 15. The pin 16 of the crank 13 is caused to slide leftward in the horizontal oblong hole 12 in the crank bearing plate 10, enabling the crank bearing plate 10 and the wick support 9 to lift the wick 8. At this time, the crank bearing plate 10 tends to move laterally upon angular movement of the crank 13. However, such lateral movement of the crank bearing plate 10 is prevented from taking place by the small-diameter portion 19 of the wick control shaft 15 which is received in the vertical oblong hole 11. The wick 8 is thus caused to move vertically only in a rectilinear direction. The wick 8 can be lifted from the extinguishing position up to the burning position by an angular movement of the wick control shaft 15 through about 60 degrees. The wick 8 can be maintained in such a burning position by a holding means which is composed of the latch shaft 45 and the actuation plate 62 as described above.

Figure 9:
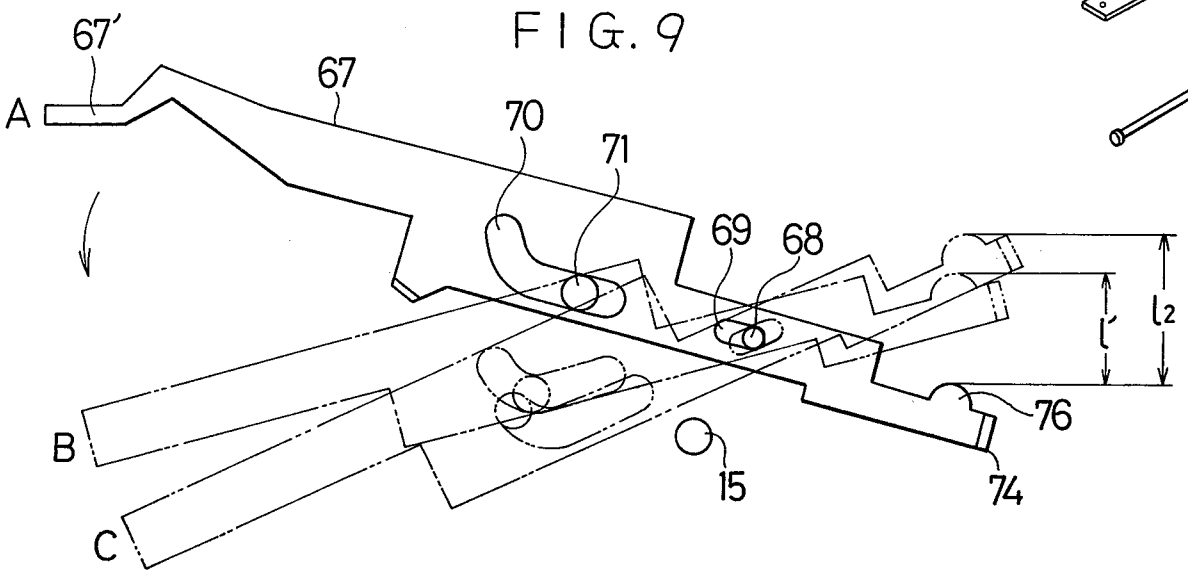
FIG. 9 is a view illustrative of the way in which a wick lifting lever.

The ignition mechanism 78 will be described with reference to FIGS. 10(A) and 10(B). The ignition mechanism 78 is shown in FIG. 10(A) as being deactivated, and shown in FIG. 10(B) as being actuated. When the lifting and lowering plate 44*a* of the ignition lever 44 is raised by the arcuate projection 76 of the wick lifting lever 67, the arms 44*b* are angularly moved counterclockwise about the pin 43, whereupon the actuation shaft 92 slides in the slots 83 in the fixture 80 toward the wick frame 6. At this time, the lifter lever 91 moves toward the wick frame 6 as the front end 94 is displaced upwardly to lift one side of the combustion cylinder 93. Simultaneously, the projections 95 of the lifter lever 91 are brought into abutment against the slanted flanges 87 of the ignition arm 84 to thereby turn the ignition arm 84, which in turn causes the ignition heater 89 to approach the wick 8 as raised. The foregoing operation of the ignition mechanism 78 is effected before the wick lifting lever 67 reaches the position B as shown in FIG. 9. The arcuate projection 76 has been raised through a stroke $l_1$ by this time. When the wick lifting lever 67 is next turned down to the position C of FIG. 9, the arcuate projection 76 is further moved upwardly through a stroke $l_2$, whereupon the ignition heater 89 has its distal end brought into contact with the wick 8 which has already completed its upward movement, as illustrated in FIG. 10(B). Concurrent with this, the contacts 96. 97 are put into contact with each other, whereupon the ignition heater 89 is energized to ignite the wick 8.

The entire operation as described above can be completed simply by depressing the pushbutton 72 on the wick lifting lever 67. Thus, the lifting of the wick 8 and its ignition by the ignition mechanism 78 can be effected in a single one-shot operation.

When the above operation is finished, the wick lifting lever 67 is returned to its original starting position under the resiliency of the return spring 73. The ignition mechanism 78 is restored from the position of FIG. 10(B) to the position of FIG. 10(A), followed by the starting of combustion of oil on the wick 8.

A means for effecting fine adjustment of the height of the wick 8 as it is lifted will be described with reference to FIG. 6. The wick 8 is kept raised unless the latch 48 is disengaged from the locking pin 64 of the actuation plate 62. As the latch shaft 45 is connected to the latch 48 through threaded engagement, rotation of the knob 46 causes the latch shaft 45 to move axially back and forth (leftward or rightward as shown in FIG. 6) slowly with respect to the latch 48 which is maintained immovably by engagement with the locking pin 64. When the latch shaft 45 is thus axially moved, the wick control shaft 15 is also slightly moved angularly through the latch shaft actuating body 51 and the swingable arm 56. Such slight angular movement of the wick control shaft 15 performs fine adjustment of the height of the wick 8. Therefore, the latch shaft 45 serves as the means for effecting fine adjustment of the height of the wick 8.

The oil burner will automatically be extinguished such as upon earthquakes. When the vibration sensor 37 vibrates in either direction under vibrations applied to the oil burner, the vertical actuation rod 38 is retracted upwardly to turn the other end of the actuation plate 62 upwardly about the rod 63. Then, the locking pawl 49 of the latch 38 is released of engagement with the locking pin 64, allowing the latch shaft 45 to return rapidly to its original position under the energy released by the spring 55. The wick control shaft 15 is quickly rotated through the latch shaft actuating body 51 and the swingable arm 56, whereupon the crank 13 and the crank bearing plate 10 cause the wick 8 to drop quickly, and the wick 8 is put out. The vibration sensor 37 incorporated is of an ordinary construction which is also sensitive to other vibrations than those due to earthquakes, such as those produced when a person or thing hits the oil burner. The vibration sensor 37 will be actuated to release the engagement between the latch 48 and the locking pin 64 before the oil burner falls due to vibrations.

To put out the oil burner under normal conditions, the extinguishing pushbutton 100 is depressed to cause the extinguishing lever 101 to act on the other end of the actuation plate 62 for dropping rapidly and extinguishing the wick 8 in the manner as described above.

The foregoing automatic and normal extinguishing operations can be effected when the holding means composed of the latch shaft 45 and the actuation plate 62 is released. Such a holding means can be released by the vibration sensor 37 in automatic extinguishing procedures, and by the extinguishing lever 102 for normal extinguishing operations.

Figure 11:
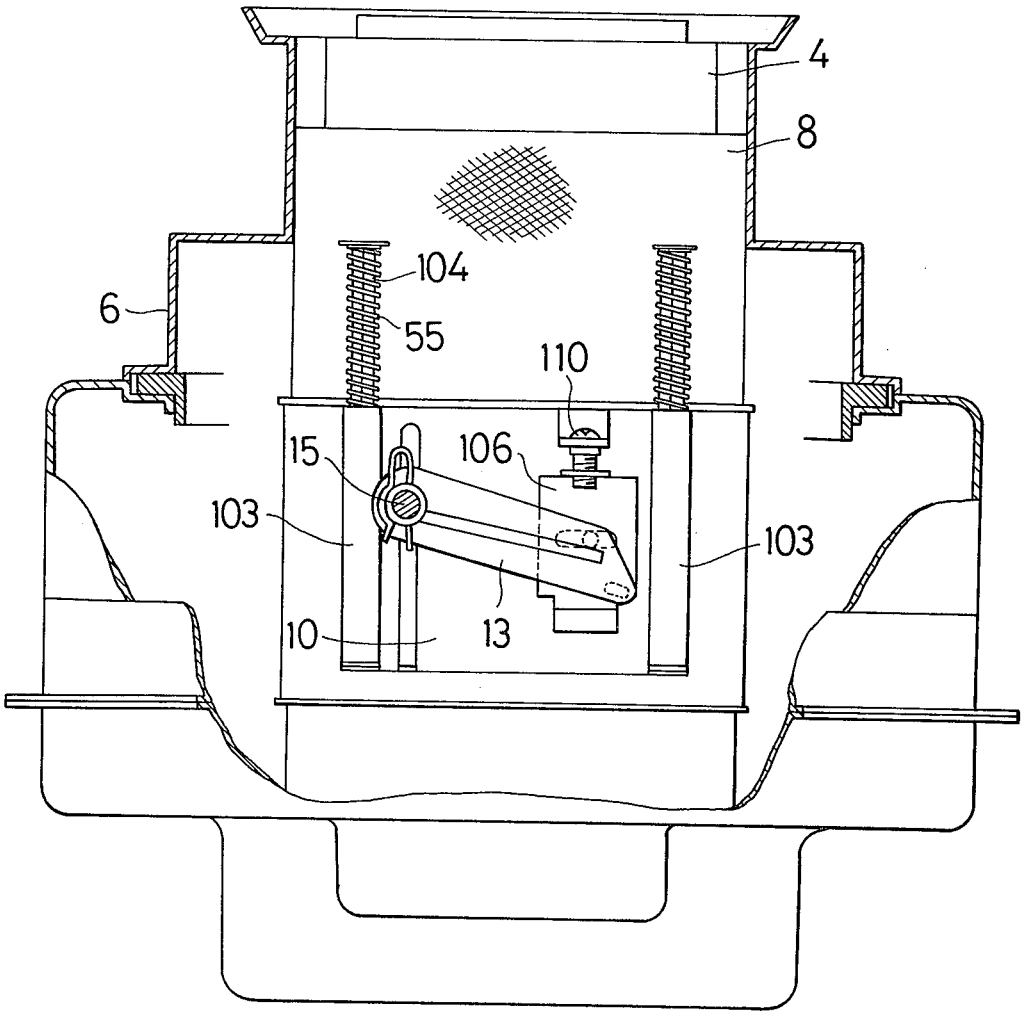
FIG. 11 is a side elevational view, partly broken away, of a portion of an oil burner according to another embodiment.
Figure 13:
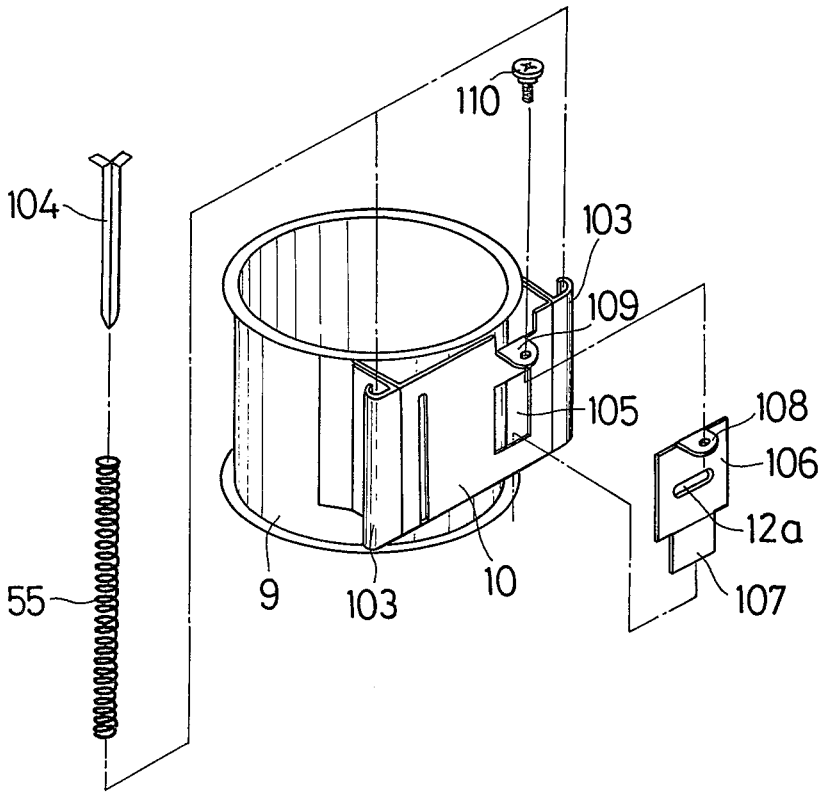
FIG. 13 is an exploded perspective view of the portion shown in FIG. 11.

An oil burner according to another embodiment of the present invention will be described with reference to FIGS. 11, 12 and 13. According to this embodiment, springs 55 for dropping the wick 8 are positioned at a different location from the position of the spring 55 in the preceding embodiment. The springs 55, 55 are disposed around guides 104, 104, respectively, which are inserted in bottomed cylindrical holders 103 that are integral with and positioned at opposite sides of a crank bearing plate 10 affixed to a wick support 9. With a wick frame 6 attached, the springs 55, 55 have upper ends held against a lower surface of a shoulder of the wick frame 6, and are compressed thereby to store energy for lowering a wick 8 which is secured to the wick support 9. When the latch 48 on the latch shaft 45 happens to be disengaged from the locking pin 64 on the actuation plate 62 for some reason, the wick 8 is immediately caused to fall under the energy released by the springs 55, 55. With the two springs 55, 55 used, the energy that can be stored therein is large, and hence the wick 8 can be lowered reliably and smoothly.

The crank bearing plate 10 has an opening 105 in which an adjustment plate 106 is mounted. The adjustment plate 106 can be attached in place by fixing an upper attachment flange 108 to a bent flange 109 on the crank bearing plate 10 with an adjustment screw 110, with a lower end portion 107 of the attachment plate 106 being positioned inwardly of the opening 105. The height or position of attachment of the attachment plate 106 with respect to the crank bearing plate 10 is determined by the position in which the attachment flange 108 is fixed to the adjustment screw 110. Thus, the height of a horizontal slot 12*a* in the adjustment plate 106 is determined by the adjustment screw 110. The wick 8 as it is lifted is adjustable in height through adjustment of the height of the horizontal slot 12*a*.

Although certain preferred embodiments have been shown and described in detail, it should be understood that various changes and modifications may be made therein without departing from the scope of the appended claims.

What is claimed is:

1. An oil burner comprising: an oil tank; an air introduction cylinder; a wick extending around said air introduction cylinder and movable upwardly and downwardly; a cylindrical wick support affixed to an outer periphery of said wick; a crank bearing plate attached to said wick support; a crank held in engagement with said crank bearing plate for moving said wick upwardly and downwardly; a shaft support base secured to said oil tank at an exterior thereof; a wick control shaft having one end rotatably supported on said shaft support base and the other end projecting into said oil tank and mounting thereon said crank; a wick lifting lever pivotably supported on said shaft suppot base for angular movement about a pivot and having a controlling end movable downwardly for rotating said wick control shaft in a direction to lift said wick; an ignition lever actuatable in ganged relation to said wick lifting lever;

ignition mechanism acting in response to the operation of said ignition lever and having an ignition heater for igniting said wick; and a return spring for returning said wick lifting lever.

2. An oil burner according to claim 1, including means for holding said wick in a position in which oil can be burned, and means for releasing said holding means.

3. An oil burner according to claim 2, wherein said holding means comprises a latch shaft movable forward in response to the operation of said wick lifting lever to lift said wick, and an actuation plate mounted in said shaft support base, having a pin for locking the latch of said latch shaft when said latch shaft is moved forward.

4. An oil burner according to claim 2, wherein said releasing means comprises an extinguishing lever projecting forward from said shaft support base, or a combination of said extinguishing lever and a vibration sensor.

5. An oil burner according to claim 1, including means for effecting fine adjustment of the height of said wick.

6. An oil burner according to claim 5, said means for effecting fine adjustment comprises a latch shaft movable in ganged relation to said wick control shaft.

7. An oil burner according to claim 3, including a spring disposed around said latch shaft within said shaft support base and compressible to store energy in response to the movement of said latch shaft in a direction to project forward, said wick being movable downwardly under the resiliency of said spring.

8. An oil burner according to claim 1, including a spring mounted on said wick support and a wick frame disposed on said oil tank and having a shoulder having a lower surface, said spring having an upper end held in abutment against said lower surface and compressible to store energy in response to the lifting of said wick, said wick being movable downwardly under the resiliency of said spring.

* * * * *